United States Patent [19]

LeClear

[11] Patent Number: 4,712,382

[45] Date of Patent: Dec. 15, 1987

[54] DEHUMIDIFIER HAVING LOW PROFILE RECEPTACLE

[75] Inventor: Douglas D. LeClear, St. Joseph Township, Berrien County, Mich.

[73] Assignee: Whirlpool Corporation, Benton Harbor, Mich.

[21] Appl. No.: 920,739

[22] Filed: Oct. 20, 1986

[51] Int. Cl.[4] ..... F25D 21/14

[52] U.S. Cl. ..... 62/150; 55/215; 55/268; 62/288; 62/291; 141/198; 200/612; 220/1 C; 220/70

[58] Field of Search ..... 62/150, 285, 288, 289, 62/291; 141/198; 220/1 C, 70; 200/61.2; 137/403; 222/57, 64; 340/618; 55/215, 268

[56] References Cited

U.S. PATENT DOCUMENTS

| | | | |
|---|---|---|---|
| 2,682,758 | 7/1954 | Harris | 62/291 |
| 2,759,335 | 8/1956 | Weschler | 62/150 |
| 2,956,417 | 10/1960 | Lyman | 62/291 X |
| 3,496,731 | 2/1970 | Sholtes | 62/291 X |
| 3,500,654 | 3/1970 | Sholtes | 62/150 |
| 4,254,311 | 3/1981 | Sisk | 62/150 X |
| 4,321,800 | 3/1982 | Gifford | 62/150 |
| 4,554,794 | 11/1985 | Khan | 62/150 |

*Primary Examiner*—William E. Tapolcai

*Attorney, Agent, or Firm*—Hill, Van Santen, Steadman & Simpson

[57] ABSTRACT

A dehumidifier is provided comprising a removable low profile receptacle for accumulating condensate generated by the dehumidifier, the receptacle defining a chamber for collecting the condensate and at least one opening for allowing condensate to enter the chamber. The receptacle further includes an integral pivoting bar for allowing the receptacle to pivot from a first position to a second position in response to an accumulation of a predetermined amount of condensate. A biased-open shutoff switch for operation of the dehumidifier components is also provided for actuation by upward movement of a portion of a perimeter edge of the receptacle. The perimeter edge portion of the receptacle contacts and closes the shutoff switch when the receptacle is located within the dehumidifier and the chamber is not filled with the predetermined amount of condensate.

19 Claims, 7 Drawing Figures

DEHUMIDIFIER HAVING LOW PROFILE RECEPTACLE

BACKGROUND OF THE INVENTION

1. Field of the Invention

The present invention relates to dehumidifiers and more particularly to receptacles for collecting the condensate of the dehumidifiers.

2. Description of the Prior Art

Dehumidifiers for removing moisture from the air including a removable receptacle for collecting a liquid condensate are known in the art. An example of a dehumidifying apparatus is disclosed in U.S. Pat. No. 2,682,758. It is known to orient these receptacles so that in response to a build-up of liquid the receptacles actuate a switch that interrupts the operation of the dehumidifier so that the receptacle can be removed and emptied.

For example, U.S. Pat. No. 4,554,794 which is owned by the assignee of the current invention, provides a dehumidifier receptacle having an integral pivoting support leg. An absent/full switch cooperates with a vertical wall of the receptacle to shut off the dehumidifier depending upon the orientation of the receptacle and amount of liquid it is holding. Due to the construction of the receptacle and absent/full switch, the receptacle must be accurately positioned each time the receptacle is replaced within the dehumidifier in order to allow the receptacle to cooperate with the absent/full switch.

U.S. Pat. No. 4,321,800 discloses a dehumidifier receptacle having an integral pivoting support leg. The receptacle cooperates with a shut-off switch actuated by a vertical wall of the receptacle. However, the switch will not sense an absent receptacle. Similarily, U.S. Pat. No. 2,759,335 discloses a low profile condensate receptacle having a unit shut-off switch that is located subjacent to a perimeter edge of the receptacle portion that moves downwardly when full. Again, however, the switch will not sense an absent receptacle.

Accordingly, it would be advantageous to have a dehumidifier with a receptacle that is easily positioned within the dehumidifier, that cooperates with a switch to shut off the dehumidifier when the receptacle is full or is absent, and that tolerates a great extent of mispositioning of the receptacle. It would be further advantageous to have such a dehumidifier with a compact low-profile design.

SUMMARY OF THE INVENTION

The present invention provides a dehumidifier having a condensate receptacle and switch for controlling the collection of liquid in the receptacle. The condensate receptacle and switch structure cooperate so that the dehumidifier is shut off when either the receptacle is absent or the receptacle is full. the receptacle is constructed and cooperates with the switch structure so that exact and precise placement of the receptacle in the dehumidifier is not required in order to effect the necessary cooperation with the switch structure. Furthermore, the dehumidifier condensate receptacle provides a low profile appearance that allows it to be utilized in smaller dehumidifier designs.

To this end, a condensate for cooperation with an apparatus that discharges a liquid during operation is provided. The apparatus includes a shutoff switch for interrupting the operation of the apparatus. The receptacle comprises a top portion including means for admitting condensate into an enclosed chamber defined by the receptacle. Pivoting means are located on a bottom of the receptacle for allowing the receptacle to pivot from a first position when the receptacle contains less than a predetermined quantity of liquid to a second position when the receptacle contains more than a predetermined quantity of liquid, in the first position a back end of the receptacle rests on a surface and a front end of the receptacle is elevated, in a second position the front end of the receptacle rests on the surface and the back end is elevated. The shutoff switch is an open shut off switch that is closed by a perimeter of the top portion coextensive with the front end when the receptacle is in the first position and is opened when the receptacle is in the second position or is absent.

Preferably, the receptacle is formed by molding a plastic material and the pivoting bar means is integrally molded with the receptacle. The receptacle also preferably includes a handle for removing the receptacle from the dehumidifier which may be integrally molded with the receptacle. The receptacle also preferably includes means for attaching a hose so that the receptacle can be emptied continuously.

DETAILED DESCRIPTION OF THE PREFERRED EMBODIMENTS

Figure 1:
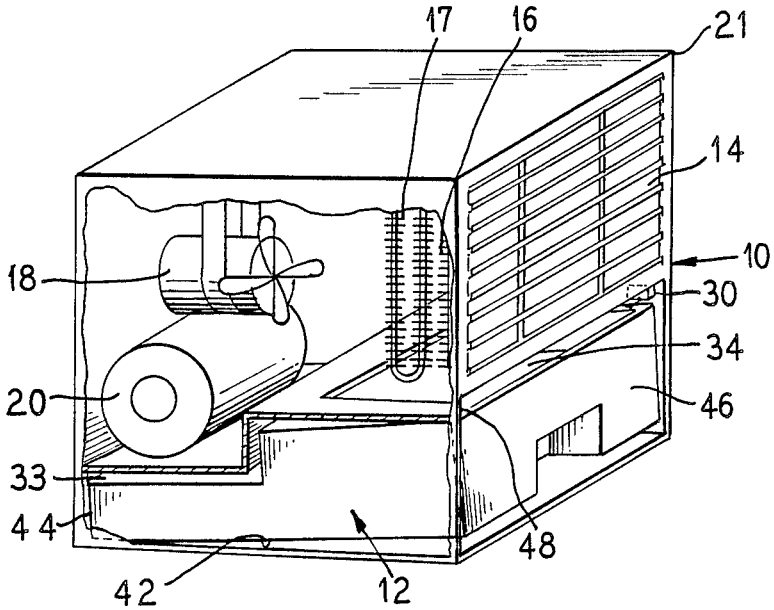
FIG. 1 illustrates a perspective view with parts broken away of a dehumidifier having a low profile receptacle of the present invention.
Figure 2:
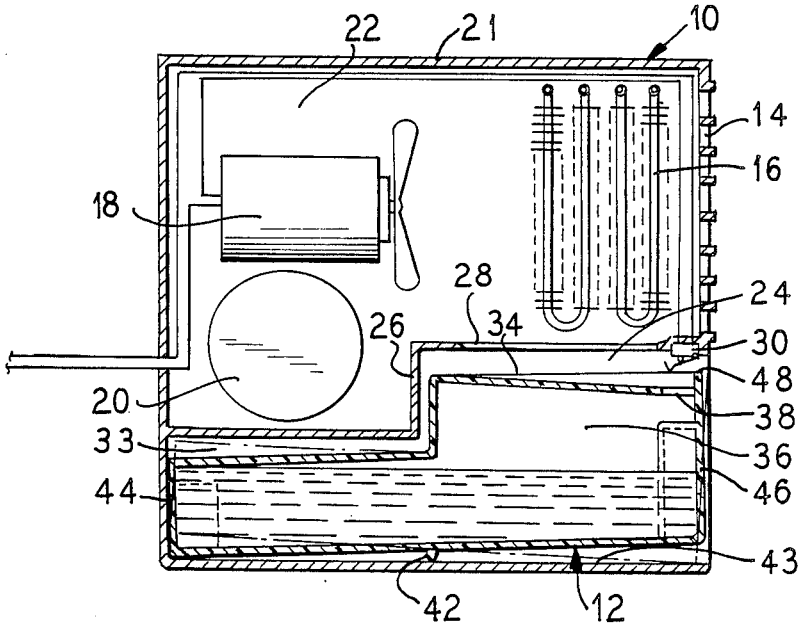
FIG. 2 is a cross-sectional side perspective view of the dehumidifier of FIG. 1.

Referring to FIGS. 1 and 2, a dehumidifier 10 utilizing the low profile receptacle 12 of the present invention is illustrated. As illustrated, the dehumidifier 10 includes an air inlet 14, evaporator element 16, condenser element 17, fan 18, and compressor 20. Preferably, the compressor 20 is a horizontal rotary compressor and as such permits the cabinet 21 to be designed and the components located so as to reduce the overall size and weight of the dehumidifier 10. In cooperation with this construction, it is desirable for the receptacle 12 to have a low profile construction. Of course, if desired, the receptacle 12 of the present invention can be utilized with other apparatus that produce liquid condensate.

As illustrated in FIG. 2, the dehumidifier 10 is divided into a top and bottom section 22 and 24 by a plate member 26. The plate member 26 includes an opening 28 that allows condensate from the evaporator elements 16 to flow into the bottom section 24. The low profile receptacle 12 is designed to fit within the bottom section 24 so that condensate that falls through the opening 28 is collected in the receptacle 12. As discussed in more detail below, the receptacle 12 cooperates with a switch 30 so that as the receptacle 12 is filled with condensate, the switch 30 is de-actuated so that the dehumidifer 10 is shut off. Likewise, when the receptacle 12 is removed from the bottom section 24 of the dehumidifier 10 the switch 30 is de-actuated so that the dehumidifier remains off.

Figure 4:
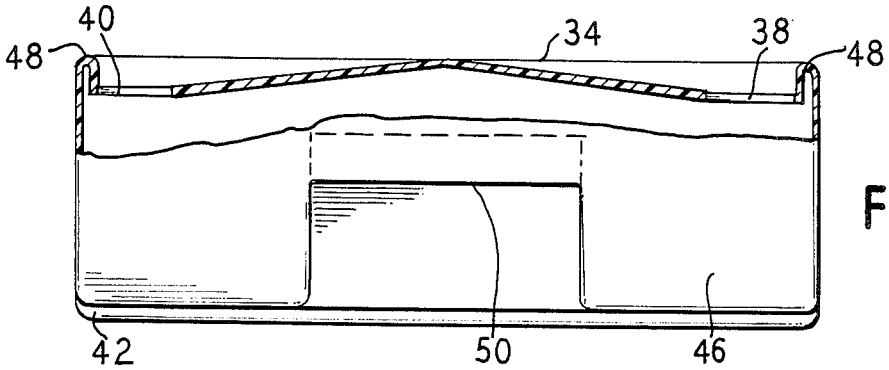
FIG. 4 is a frontal view of the low profile receptacle of the present invention.
Figure 3:
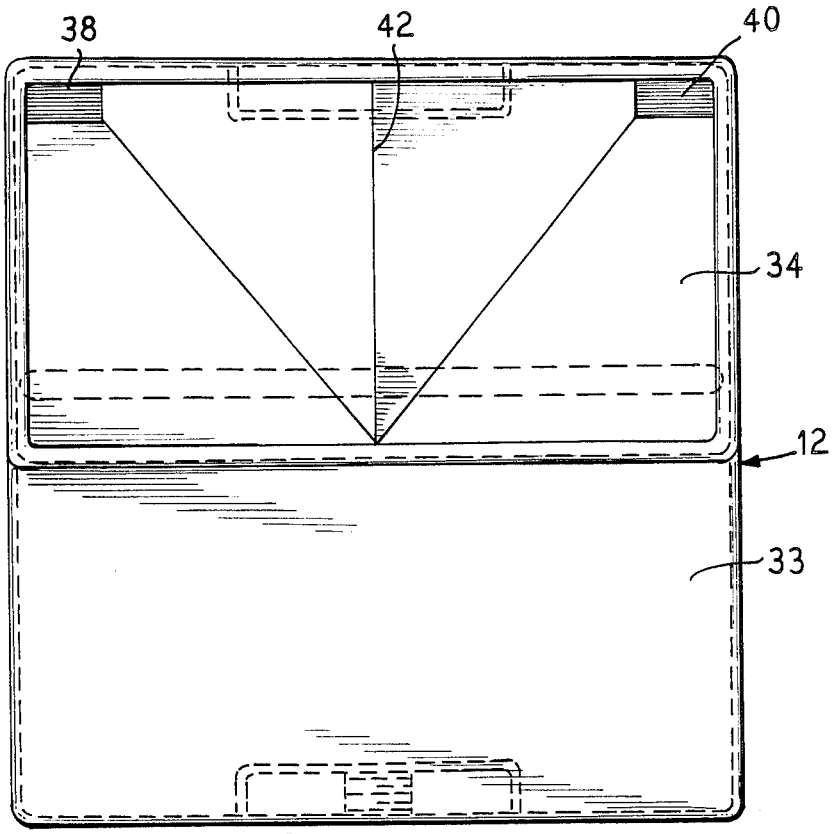
FIG. 3 is a top elevational perspective view of the low profile receptacle of the present invention.

The receptacle 12 has a stepped configuration having a first lower surface area 33 and a second upper surface area 34. The receptacle 12 defines therein a chamber 36 for containing condensate. As illustrated in FIG. 3 and 4, the upper surface area 34 of the receptacle 12 includes a surface that is sloped toward apertures 38 and 40. The upper surface area 34 is sloped so that condensate that falls onto the surface is directed to a front of the receptacle 12 where it can be collected in the apertures 38 and 40 forwardly and outwardly in the upper surface area. The upper surface area 34 also includes a ridge area 41 that divides the upper surface area into halves to direct the fluid away from the center portion of the upper surface area 34 to the sides and specifically to the apertures 38 and 40. As illustrated in FIG. 2, the upper surface area 34 lies directly underneath the opening 28 in the plate member 26 of the dehumidifier 10.

The receptacle 12 includes pivoting means that includes an integral balance bar or leg 42 for pivoting the receptacle 12 from a first position to a second position in response to liquid accumulation in the chamber 36 of the receptacle. To this end, the bar 42 is located at a position parallel to, but off the center line toward the front end 46 of the receptacle 12. Accordingly, when the receptacle 12 is empty and located on a flat surface the location of leg 42 causes the receptacle to be tilted or oriented so that the back end 44 of the receptacle 12 touches the surface and the front end 46 of the receptacle is elevated. This is the first, or empty, position. A perimeter edge 48 extends from the back to the front of the receptacle 12 along both sides of the receptacle. The switch 30 is located superjacent the portion of perimeter edge 48 of the receptacle 12 that is coextensive with the front end 46 of receptacle 12. Accordingly, the perimeter 48 of the front end 46 of the receptacle contacts the switch 30 in this first position. Because the switch 30 is a biased-open shut off switch, when the front end 46 of the receptacle, and specifically the perimeter 48, contacts the switch 30 the switch allows the dehumidifier 10 to operate. As used herein, the term "biased-open shutoff switch" means a switch that is biased to an open position wherein current flow to operative components of the unit is interrupted. As condensate is collected in the receptacle 12, due to the receptacle's stepped construction once the chamber 36 is filled to a level wherein the area underneath the lower surface 33 is filled, the additional area underneath the upper surface 34 will begin to fill and the center of gravity of the receptacle 12 will move towards the front end 46 of the receptacle causing the receptacle to tilt towards its front end 46. Accordingly, once the liquid reaches a predetermined height in the portion of the chamber 26 underneath the upper surface 34, the front end 46 of the receptacle 12 will rest on the surface 43 causing the receptacle 12 to no longer contact the switch 30. Because the switch 30 is a biased-open shutoff switch, this will cause the switch to interrupt the current flow causing the dehumidifier 10 to shut off.

The bar 42 is integral with the receptacle 12. Accordingly, a predetermined and repeatable pivoting of the receptacle 12 in response to a predetermined amount of condensate is not dependent upon critical positioning of the receptacle in the dehumidifier 10. Instead, regardless of where the receptacle 12 is positioned within the chamber 24 of the dehumidifier 10, it will pivot in response to a predetermined amount of condensate. This is in constrast to some previous receptacle dehumidifier constructions that required exact placement of the receptacle within the dehumidifier in order to function satisfactorily.

Moreover, the use of a normally open shutoff switch 30 that is located above the front end 46 of the receptacle 12, and specifically the portion of perimeter edge 48 of the receptacle that is elevated when the receptacle is empty, also facilitates tolerances of the receptacle's mispositioning. Due to the receptacle's long, low profile construction, the actuating portion of perimeter edge 48 of the receptacle will travel a relatively long distance as the receptacle fills. The switch 30 can therefore have an actuation point close to its outermost biased position and therefore have a lot of overtravel. This arrangement of the switch 30 and receptacle 12 will sense the presence of an empty receptacle and notice a full or missing receptacle 12 even if the receptacle 12 is only partially inserted in the dehumidifier 10.

The construction of the receptacle 12 provides an arrangement that is conducive to its use in the dehumidifier 10 illustrated. To this end, the receptacle 12 cooperates with the horizontal compressor 20 by having a low profile that extends the full depth of the dehumidifier 10. Furthermore, the stepped construction of the receptacle 12 is conducive to use with the horizontally oriented compressor 20; preferably, the length of the receptacle 12 is at least twice the height of the receptacle.

Figure 5:
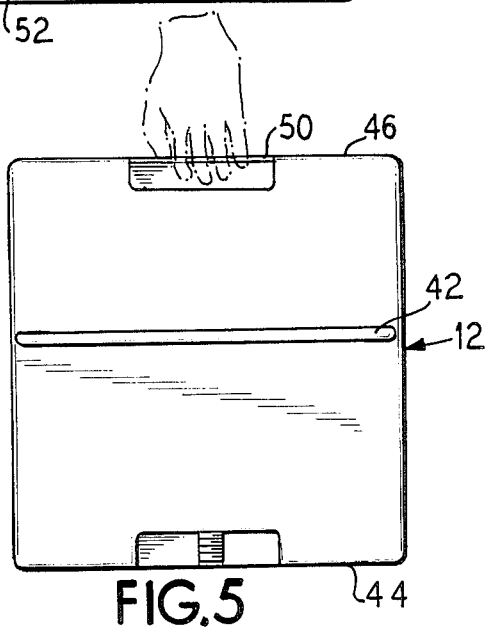
FIG. 5 is a side elevational view of the low profile receptacle being held perpendicularly by its handle.

Referring now to FIGS. 4 and 5, the receptacle 12 preferably includes a handle 50. This handle 50 is defined by a molded indentation in the front end 46 of the receptacle 12. The handle 50 provides an easy means for removing the receptacle 12 from the dehumidifier 10. Moreover, as the receptacle 12 is removed by the handle 50, due to the low profile construction of the receptacle 12 even if the receptacle 12 is held perpendicularly by the handle 50, as illustrated in FIG. 5, water will not leak out of or be spilled out of the receptacle 12. Accordingly, the handle 50 cooperates to provide a spill resistant receptacle 12.

Also, the relatively small apertures 38, 40 when compared to the cross-sectional size of the receptacle provide a measure of spill resistance even when the receptacle is carried horizontally and thus subject to sloshing. This is an improvement over known devices that utilize receptacles such as pans or buckets that have a large opening.

Figure 6:
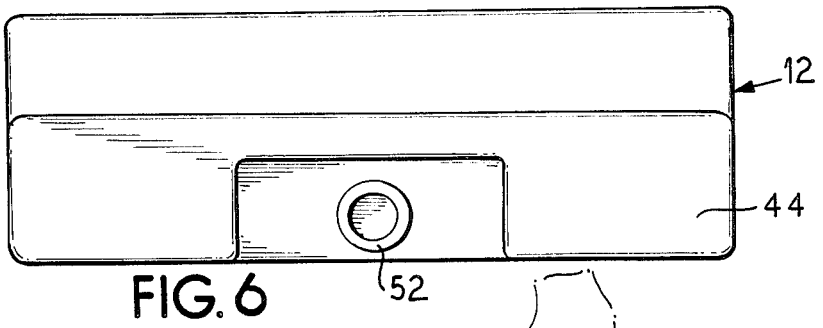
FIG. 6 is a back elevational view of the low profile receptacle of the present invention.
Figure 7:
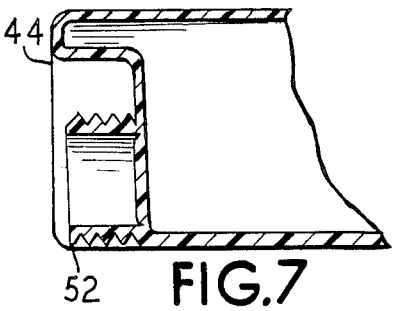
FIG. 7 is a cross-sectional view taken along lines VII-VII of FIG. 6.

Referring to FIGS. 6 and 7, located at the back end of the receptacle 12, in the preferred embodiment illustrated, is a threaded hose connection 52. The threaded hose connection 52 allows a hose (not illustrated) to be connected to the receptacle to continually drain away condensate to a floor drain if available. When not in use, the hose connection 52 can be covered by a cap (not shown) or other means. Of course, other means of emptying the receptacle 12 can be utilized or the receptacle 12 can be emptied through the apertures 38 and 40.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of my contribution to the art.

The embodiments of the invention in which an exclusive property or privilege is claimed are defined as follows:

1. A condensate receptacle for cooperation with an apparatus having operative components that discharge a liquid during operation and shutoff switch means for selectively energizing said operative components, the receptacle comprising:

a top portion including means for admitting condensate into a chamber defined by the receptacle;

pivoting means located on a bottom of the receptacle for allowing the receptacle to pivot from a first position to a second position when a predetermined amount of liquid is admitted into the chamber, in the first position a back end of the receptacle rests on a surface of the apparatus and a front end of the receptacle is elevated, in the second position the front end of the receptacle rests on the surface and the back end is elevated; and the shut-off switch means is a biased-open shutoff switch having an actuator located superjacent a portion of a perimeter of the top portion of the receptacle, the shut-off switch is closed energizing the operative components by the perimeter of the top portion of the receptacle when the receptacle is in the first position and is opened deenergizing the operative components when the receptacle is in the second position or absent.

2. The receptacle of claim 1 wherein the pivoting means includes an integral leg.

3. The receptacle of claim 1 including a handle on a front end of the receptacle.

4. The receptacle of claim 1 including means for attaching a hose located on a back end of the receptacle.

5. The receptacle of claim 1 wherein the top portion comprises a generally imperforate sheet, the means for admitting condensate includes at leaset one aperture and the top portion sheet includes a surface sloping towards the aperture.

6. The receptacle of claim 1 wherein the receptacle has a step-like cross-sectional construction.

7. A dehumidifier comprising:

condensing means for converting ambient water vapor to a liquid condensate;

a removable low profile receptacle for accumulating the condensate generated by the dehumidifier, the receptacle defining a chamber for collecting the condensate and at least one opening for allowing condensate to enter the chamber, the receptacle including pivoting means for allowing the receptacle to pivot from a first position wherein a front end of the receptacle is elevated to a second position wherein a back end of the receptacle is elevated in response to an accumulation of a predetermined amount of condensate;

a normally open shut-off switch for interrupting the operation of the dehumidifier and located superjacent a perimeter of the receptacle; and the perimeter of the front end of the receptacle contacting and closing the shut-off switch when the receptacle is located within the dehumidifier and the chamber is not filled with the predetermined amount of condensate.

8. The dehumidifier of claim 7 wherein the receptacle includes a handle for removing the receptacle from the dehumidifier.

9. The dehumidifier of claim 7 wherein the receptacle includes a top portion having the opening for allowing the condensate to enter the chamber, the top portion having a surface sloped towards the opening.

10. The dehumidifier of claim 7 wherein the receptacle includes a hose connection at an end thereof.

11. The dehumidifer of claim 7 wherein the receptacle has a stepped cross-sectional construction.

12. The dehumidifier of claim 7 wherein the pivoting means is an integral leg located at an off center position on a bottom of the receptacle.

13. The dehumidifier of claim 7, wherein the low profile receptacle has a length at least two times as great as a height of the receptacle.

14. A dehumidifier comprising:

a removable low profile receptacle for collecting condensate generated by the dehumidifier, the receptacle having a stepped cross-sectional shape and defining a chamber for collecting the condensate, the receptacle further including a top surface having at least one opening for allowing condensate to enter the chamber and a pivot leg on a bottom surface thereof for causing the receptacle to pivot from a first position to a second position in response to an accumulation of condensate, a front end of the receptacle being elevated in the first position and a back end of the receptacle being elevated in the second position; and an open shutoff switch for interrupting the operation of the dehumidifier, at least a portion of the front end being located subjacent to the open shutoff switch and contacting the switch when the receptacle is in the first position, the open shutoff switch interrupting the operation of the dehumidifier when the portion of the front end of the receptacle is not contacting the switch.

15. The dehumidifier of claim 14 wherein the receptacle includes a handle.

16. The dehumidifier of claim 14 wherein the top surface includes two openings and means for directing condensate into the openings.

17. The dehumidifier of claim 16 wherein the means for directing is a sloped surface.

18. The dehumidifier of claim 14 including a horizontally oriented compressor.

19. The dehumidifier of claim 14 wherein the receptacle includes means for attaching a hose at an end thereof.

* * * * *